United States Patent [19]

Berstein

[11] 4,327,568

[45] May 4, 1982

[54] METHOD FOR THE COLD ROLLING OF PARTS

[75] Inventor: Garri Berstein, Erkelenz, Fed. Rep. of Germany

[73] Assignee: Wilhelm Hegenscheidt Gesellschaft mbH, Erkelenz, Fed. Rep. of Germany

[21] Appl. No.: 132,675

[22] Filed: Mar. 21, 1980

[30] Foreign Application Priority Data

May 23, 1979 [DE] Fed. Rep. of Germany ..... 2920889

[51] Int. Cl.[3] ..... B21D 22/00

[52] U.S. Cl. ..... 72/199; 72/56; 72/76; 29/DIG. 46

[58] Field of Search ..... 72/56, 54, 57, 199, 72/365, 366, 76; 29/DIG. 46

[56] References Cited

U.S. PATENT DOCUMENTS 3,318,129 5/1967 Gross ..... 72/199

3,444,714 5/1969 Gustkey ..... 72/76

FOREIGN PATENT DOCUMENTS 133324 10/1951 Sweden ..... 29/DIG. 46

456716 1/1975 U.S.S.R. ..... 72/76

*Primary Examiner*—Leon Gilden

*Attorney, Agent, or Firm*—Arthur B. Colvin

[57] ABSTRACT

The present invention relates to a method of cold rolling metal parts to achieve improved surface uniformity and hardening. The method comprises applying to the work piece a pulsating force at a frequency of from about 30 to 300 the duration of the pulses being at least twice the time between pulses. The pulsating force varies from about 10% to 100% above the minimum force necessary to achieve a smooth rolled finish. The method contemplates just statically rolling the work piece and thereafter applying the pulsing force which, in such instance may reduce to zero.

2 Claims, 3 Drawing Figures

METHOD FOR THE COLD ROLLING OF PARTS

Figure 1:
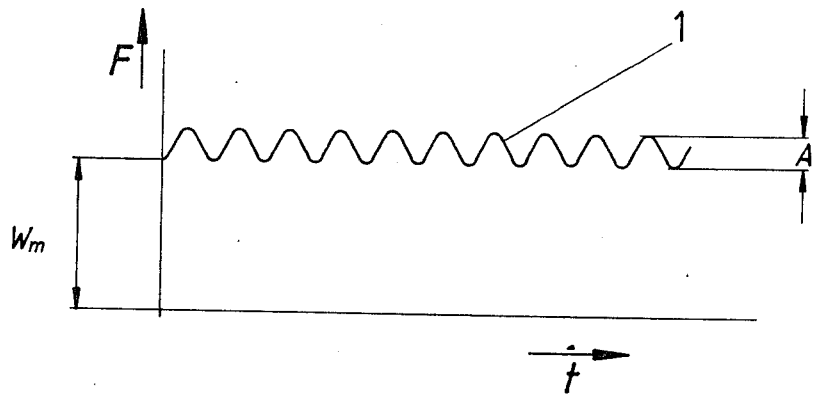

This invention relates to a method for hardening parts by cold rolling with a rolling force greater than zero.

Methods of this kind have become known from German Patent No. 26 09 787, for example. The said patent discloses a rolling die suited for cold rolling the fillets of crankshafts with a rolling force greater than zero. This kind of rolling has become known by the name of "hard rolling". In order to obtain the desired increase in fatigue strength, comparatively large forces are required which lead to undesired deformations of the part. Despite the comparatively large forces, the depth of the hardened zone is too shallow to be completely satisfactory.

It is also known, for instance through U.S. Pat. No. 3,444,714, to provide dies for the cold rolling of parts, in a procedure in which the rolls are thrown in pulsating fashion agaist the workpiece surface resulting in a sort of hammer action and possible distortion of the work piece. The hardening depth obtained is very shallow, and after each pulse the rolling force drops to zero. The rolling method carried out with dies of the noted type is known by the term "dynamic rolling".

Further having become known through the German Provisional Patent No. 21 13 363 is a die for the cold rolling of parts, designed quite similar to and working by the same principle as the die according to the already cited U.S. Pat. No. 3,444,714. However, after the rolling die pulse the rolling force does not drop directly to zero, but at first only to a relatively low intermediate value which is retained for a short period of time and then drops to zero. This is accomplished in that, after the pulse, the rolls drop back on a curved portion of the support element enclosing or supporting them, rolling off between this curved portion and the workpiece surface. The purpose of the progressive force reduction is to assure that the rolling force of all rolls does not become zero at the same time, with the result that the die can no longer be kept in motion. Additionally, the progressive force reduction guards against the possiblity that all rolls remain in their respective depressions and stay caught there so that they can no longer perform their function. The work result is the same as that of the already cited U.S. patent.

Further having become known by the term "smooth rolling" is a widely applied method for the cold rolling of parts with a force greater than zero, its objective being the improvement of the surface uniformity of workpiece. (See, for instance, publication series "Feinbearbeitung—Das Industrieblatt", vol. one "Smooth Rolling" 1954).

It is an object of the invention to provide a method for the cold rolling of parts, by which a surface quality known from the smooth rolling method can be obtained on the one hand and by which a greater hardening depth and/or microhardness is achieved on the other, whereby an improvement of the fatigue strength of the part over the hitherto known hard rolling method (e.g. German Pat. No. 26 09 787) can be achieved.

In accordance with the invention an improved rolling result is achieved by applying to the work piece a rolling force pulsating at a frequency of from about 30 to 300 Hz, the minimum amplitude of the force being the minimum static rolling force necessary to achieve a smooth rolling result, the maximum amplitude being from about 10 to 100% above the minumum, and the period between pulses being no greater than twice the pulse duration.

Superposing over a static basic rolling force a pulsating rolling force of the stated frequency and amplitude unexpectedly results in a considerable increase in hardening depth and microhardness as compared to a static hard rolling force of maximum amplitude. To the extent that it is caused by the pulsation, the workpiece deformation caused by the pulsatingly driven die is essentially within the elastic range and thus measurable surface corrugations are not caused by it. This, in essence, is the reason why the surface qualities obtainable by the known smooth rolling method are surpassed by the method according to the invention with resultant great advantages in increasing the fatigue strength of parts.

It is further proposed according to the invention that the rolling force pulsate at a frequency of 30–300 Hz and the minimum rolling force correspond to the static force requird to obtain a desired rolling result, and the maximum of the pulsating force correspond to the force required to obtain a desired hardening depth and/or desired increase in microhardness, the points of maximum force of the rolling die impressions following each other by a period no greater than twice the length of the impression itself. What is achieved by the definitions given here is that, in addition to the desired increase in fatigue strength, a desirable smooth rolling result is obtained at the same time, i.e., a workpiece surface of the desired quality. Since the invention relates to a rolling method, it is necessary that workpiece and die move relative to each other during the execution of the method. Since the rolling force is necessarily exerted by th die, the time from one rolling force peak to the next rolling force peak can be determined, at constant frequency of the force, from the velocity of the relative motion of die and workpiece. The period between these maxima is critical to the desired result. Nor must such period, too great per se, be shortened by several phase-shifted passes of the workpiece because, under such circumstances, this may cause the actual die frequency acting upon the workpiece to become too low. The invention teaches what the maximum of these spacings may be.

Due to the greater hardening depth achievable by the method according to the invention, it also becomes possible, in addition to the advantages noted to machine a workpiece treated in this manner with cutting tools subsequent to rolling, e.g. to correct its shape and dimensions, without noticeable loss in fatigue strength. Despite the subsequent machining, the parts do not fall below the fatigue limit achieved by rolling techniques heretofore known which do not permit subsequent machinings.

It is further proposed according to the invention that rolling take place first with a static rolling force and-subsequently with a pulsating rolling force. This means that the method according to the invention is split into its two principal components which are carried out independent of each other. This makes possible an inspection of the work results of the individual steps and permits, in addition, the use of separately working, different tools, making it possible to simplify them.

It is proposed according to another embodiment of the invention that the upper limit of the pulsating rolling force not exceed 100% of the static rolling force. On the one hand, an expedient upper limit is thus given, and on the other hand, it is thus taught that, for instance, if the rolling operation is carried out with static rolling force independent of the rolling operation with pulsating rolling force, the pulsating rolling force may drop to zero in its minimum. Due to the fact that, in such case, the lower limit of the pulsating rolling force need no longer be headed, the entire method is simplified without thereby reducing the quality of the result.

Figure 2:
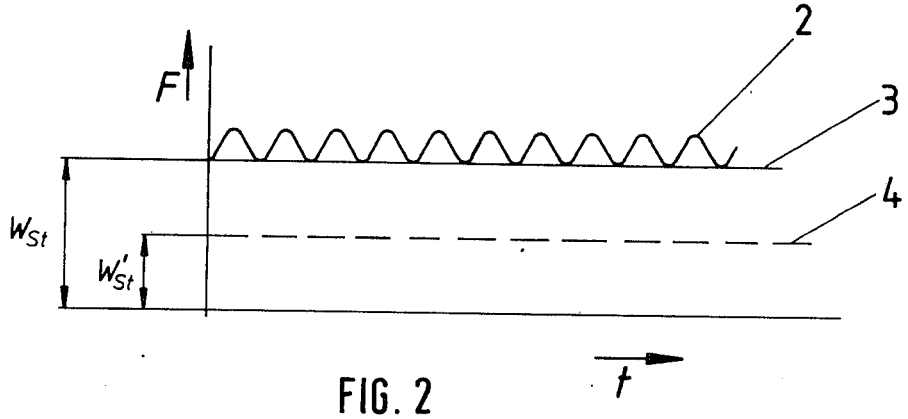
Figure 3:
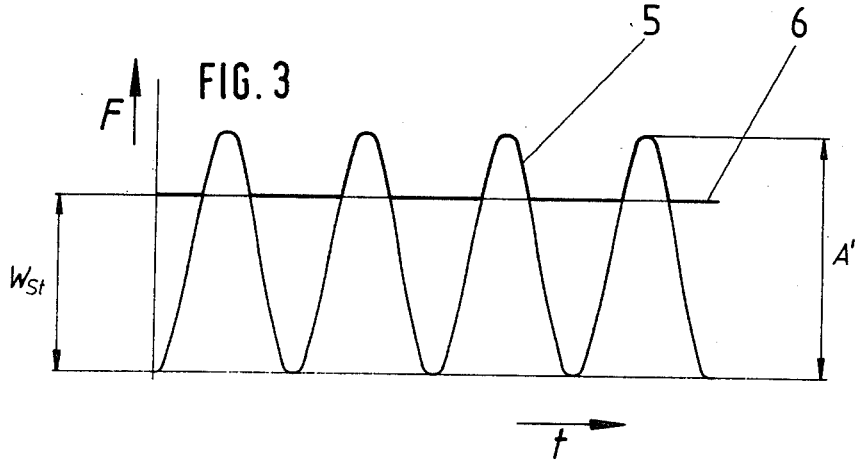

Shown in FIGS. 1 to 3, are, as examples, force diagrams of a possible rolling force curve.

In FIG. 1, the force F is plotted over the time t. The force curve is represented by the line 1. It is evident that the force F fluctuates by the amplitude A, starting from the minimum Wm.

The same co-ordinate system as in FIG. 1 is used in FIG. 2. The curve of the pulsating force component is here represented by the line 2. However, prior to or simultaneous with the pulsating treatment, rolling takes place with a static rolling force of the magnitude Wst, for example, its curve being represented by the line 3. But it is by no means necessary for the result that the static rolling force be in the order of magnitude of the minimum of the dynamic rolling force. The rolling operation can just as well be carried out with a static force such as of the magnitude W'st, the curve of which is represented by the broken line 4.

FIG. 3 also utilizes the co-ordinate system already mentioned. It shows that the rolling operation can be carried out statically with a static rolling force Wst, the curve of which is represented by the line 6, and that this static component can now be superposed by a dynamic component of the amplitude A'. It is evident that the minimum of the dynamic component can here approach zero. Effective for the result is only that portion of the dynamic force component shown in bold lines, as represented by the line 5. It may be seen at the same time that the oscillation curve of the dynamic force component need by no means necessarily be sine-shaped.

The invention may be applied to known machines such as described in the German Pat. No. 21 46 994, e.g. FIG. 1. Crankshafts are smooth and hard rolled on these machines. The dies required therefore are illustrated, for instance, in FIGS. 2 to 6 of the said German patent. The dies are pushed against the workpiece with the required force by the levers 13 and 10. The force is generated by hydraulic cylinders. Now, if a pulsating fluid stream acts upon these hydraulic cylinders it is possible to obtain a force curve as shown in FIGS. 1 to 3 of the invention. It goes without saying that the method according to the invention is not restricted to the application described.

Having thus described the invention and illustrated its use, what is claimed as new and is desired to be secured by Letters Patent is:

1. The method of cold rolling metal parts with a positive rolling force which is characterized by applying to the part a force which pulsates at a frequency of from about 30 Hz to 300 Hz, the value of the minimum effective rolling force applied during such procedure corresponding essentially to a value of the minimum static force required to achieve a smooth rolling result, the amplitude of such force above said minimum varying from about 10% to 100% of said minimum force, the distance between successive pulse maxima being not greater than about twice the total pulse duration.

2. The method in accordance with claim 1 where said pulsating force is applied after said part is first subjected to a static rolling force of at least said minimum value.

* * * * *